US005826398A

United States Patent [19]

Carnicle

[11] Patent Number: 5,826,398

[45] Date of Patent: Oct. 27, 1998

[54] DEVICE AND METHOD FOR PROTECTING FROM REINFORCEMENT BAR INJURY

[76] Inventor: Michael A. Carnicle, 11100 E. Dartmouth Ave., No. 16, Aurora, Colo. 80014

[21] Appl. No.: 647,428

[22] Filed: May 22, 1996

[51] Int. Cl.[6] ..... E04C 5/16; E04H 17/14

[52] U.S. Cl. ..... 52/698; 52/301; 52/741.3; 52/749.1; 256/59; 256/DIG. 6

[58] Field of Search ..... 52/40, 244, 298, 52/296, 300, 301, 677, 689, 698, 704, 741.3, 749.1, DIG. 12; 138/96 R, 96 T; 248/188.9, 511, 519, 523; 256/59, 65, DIG. 6; 285/92; 254/100, 133

[56] References Cited

U.S. PATENT DOCUMENTS

| | | | |
|---|---|---|---|
| 1,375,043 | 4/1921 | Finlayson | 52/698 X |
| 1,532,729 | 4/1925 | Carlson | 52/689 X |
| 3,504,879 | 4/1970 | Strickland | 254/100 X |
| 3,921,356 | 11/1975 | Hughes | 52/370 X |
| 4,313,688 | 2/1982 | Daniels | 52/301 X |
| 4,614,070 | 9/1986 | Idland | 52/296 |
| 5,363,618 | 11/1994 | Underwood | 52/301 |
| 5,447,290 | 9/1995 | Workman | 52/300 X |
| 5,487,618 | 1/1996 | Cox | 52/301 X |
| 5,488,810 | 2/1996 | Horton | 52/301 X |
| 5,568,708 | 10/1996 | Kassardjian et al. | 52/300 X |
| 5,613,336 | 3/1997 | Workman | 52/301 |

FOREIGN PATENT DOCUMENTS

| | | | |
|---|---|---|---|
| 221421 | 9/1924 | United Kingdom | 52/301 |

OTHER PUBLICATIONS

"EPB Elevated Post Bases" and J/JP Floor Beam Leveller; Sweet's Catalog File; 6.6/Sim, 1982.

*Primary Examiner*—Carl D. Friedman
*Assistant Examiner*—Kevin D. Wilkens
*Attorney, Agent, or Firm*—Ramon L. Pizarro; Edwin H. Crabtree

[57] ABSTRACT

An apparatus and method for covering an exposed end of at least one exposed reinforcement bar at a construction site. The apparatus includes a substantially flat portion adapted for receiving a removeable bumper such as a two-by-four piece of lumber, a collar for securing the substantially flat portion over the end of a bar. Once the apparatus is placed over the exposed end of the bar a removeable bumper such as a two-by-four piece of lumber may be placed over the substantially flat portion, so that the exposed end of the bar is covered by the two-by-four piece of lumber resting over the substantially flat portion.

8 Claims, 3 Drawing Sheets

DEVICE AND METHOD FOR PROTECTING FROM REINFORCEMENT BAR INJURY

BACKGROUND OF THE INVENTION (a) Field of the Invention

This invention generally relates to the field of devices and methods for protecting from injury from projecting rods and reinforcement bars at construction sites, and more particularly, but not by way of limitation, to a device and method for covering the ends of exposed reinforcement bars in order to prevent injury.

(b) Discussion of Related Art

The need to provide an apparatus and method for protecting individuals from injury from exposed concrete reinforcement bars, or "rebar", at construction sites has long been recognized. While concrete structures are under construction, the steel reinforcements are frequently left exposed in both horizontal and vertical directions. This presents a serious hazard to workers or passers by who may inadvertently scrape, gouge, or even accidentally impale themselves by falling on the exposed reinforcement bar.

Perhaps the most common approach at solving the problems associated with the hazards associated with exposed rebar has been to provide a protective cover with some sort of a load distributing tip. For example, U. S. Pat. No. 5,381,636 to Kassardjian et al. teaches the use of a protective cover for concrete reinforcing bars. The Kassardjian device includes a protective cover that is attached to an elongated cylindrical collar that has been adapted for securing the device to the exposed end of a bar. The device also includes a cap that is attached to the collar by reinforcing ribs, and a load distributing seat between the collar and the cap. This arrangement provides an effective means for covering, and thus protecting from injury from, an exposed end of a reinforcement bar. However, the device is limited in that it can cover only one bar at a time, and thus a user must include one of each of the Kassardjian devices over each of the exposed reinforcement bars. This requirement can be very expensive with regards to the number of protective devices needed, the amount of labor required to install and remove these devices, and the storage and handling expenses associated with handling such a large number of elements. Moreover, the Kassardjian device requires a metal seat between an attachment sleeve and a protective cover, a requirement that can prove expensive in the manufacture of the device as compared to purely plastic devices, which are complete when ejected from the mold. Also, by having more than one part per completed device, the manufacturer must make and stock two parts per completed device, all of which increases the cost of the finished product.

Still further, devices that attach to a single exposed bar are limited in the size of the protective head, or cap, that can placed over the sleeve that typically attaches the device to the bar. Large heads supported at a single point will simply bend or break away from the support because of the large bending moment produced by loads, such as the weight of a falling person, at the extreme edges of the head.

Other example, U.S. Pat. No. 5,313,757 to Schnepf, also teach the use of caps that can be used to cover a single exposed bar at a time. The Schnepf device includes a sleeve portion with a cover that fits over a metal reinforcing disk which spreads out impact loads. However, the Schnepf device suffers from the same disadvantages as the Kassardjian device because one Schnepf device must be placed over each exposed bar. Also, as explained above, the assembly of a metal disc within a plastic cap increases the manufacturing costs of the device.

Yet another approach at this problem is taught in U.S. Pat. No. 4,202,378 to Bush et al., which also teaches the use of a safety cap for covering the end of an exposed reinforcement bar. The Bush safety cap includes a generally circular, flat head and a slotted sleeve with internal gripping ribs to secure the device to a single exposed bar and to dampen the impact of a person falling or colliding with the flat, circular head. Like the previously discussed inventions, the Bush device suffers from the limitation that it can only be used to cover a single exposed bar at a time. Moreover, the Bush device prevents impalement by spreading the load with a device that is made entirely from plastic materials, an approach that can prove to be very dangerous due to the weakness of plastic.

Thus there remains a need for a simple device and method for protecting people from injury cause by contact with the exposed ends of rebar at construction sites.

Moreover there remains a need for a safety device to prevent impalement which is simple and inexpensive to manufacture and install, and which spreads out impact loads when someone accidentally falls or runs into an exposed reinforcement bar.

Still further, there remains a need for a bar covering device that can be used to cover several exposed reinforcement bars at one time.

Still further, there remains a need for a reliable device and method for providing improved protection from injury due to falling or accidental collisions with exposed sections of reinforcement bars at construction sites. There remains a need for a safety device for covering the ends of exposed reinforcement bars, and which can present a large impact area to the person falling or colliding with the device.

SUMMARY

In light of the foregoing, an apparatus for covering an exposed end of at least one exposed reinforcement bar has been discovered. A preferred version of the apparatus includes:

(a) a sleeve for securing the apparatus to the end of a bar; and (b) a substantially flat portion adapted for receiving a removeable bumper, the substantially flat portion being in a substantially perpendicular position over the sleeve and being adapted for receiving the bumper over the substantially flat portion, so that the bumper can be removably attached over the substantially flat portion and used to cover several exposed reinforcement bars at one time, thereby preventing injury caused by contact with an exposed end of the bar.

To enhance the ability to removably attach the bumper to the substantially flat portion, the substantially flat portion may be part of a generally saddle shaped section that includes the substantially flat portion. The generally saddle shaped portion is defined by the substantially flat portion, which would include at least two substantially parallel edges and a pair of substantially vertical side walls, each side wall extending substantially vertically from one of the substantially parallel edges. The substantially vertical side walls can further include at least one resilient cantilevered protrusion that extends from the side walls and over at least part of the flat portion, so that the resilient cantilevered protrusions may serve to retain the bumper which has been placed over the substantially flat portion.

It is preferred that the bumper be a piece of lumber, such as a two-by-four piece of lumber. The two-by-four, which actually measures 1 ⅝ inches by 3 ½ inches, is typically abundant at the construction site, where it is used as part of the structure or used to fabricate construction aids, such as temporary braces and the like. Therefore, the availability of the two-by-four at the construction site makes this type of lumber a preferred choice for the bumper to be placed over the substantially flat portion of the invention. Also, the length of the two-by-four will allow the device to be used to cover several exposed bars at one time; thereby saving on the number of devices that must be purchased and installed in order to achieve adequate safety at a construction site. Still further, the fact that the instant invention can be used to support a two-by-four at several points will provide a more stable structure that results in improved load distribution.

According to yet another aspect of the invention, a method for covering an exposed end of at least one reinforcing bar at a construction site has been discovered. The method generally includes the following steps:

(a) attaching a cylindrical sleeve to the end of an exposed bar;

(b) providing a generally saddle shaped member adapted for receiving a two-by-four on the cylindrical sleeve;

(c) placing a two-by-four in the saddle shaped portion, so that the exposed end of the bar is covered by the two-by-four in the saddle shaped portion, thereby preventing injury caused by contact with an exposed end of the bar. Thus, by providing a device that attaches to the exposed reinforcement bars, and providing an area for attaching a two-by-four over the invention and the end of the bar one can solve many of the problems that had been left unsolved by the prior art, and achieve new useful results that were heretofore unachievable with known devices. For example, with the disclosed invention one may take advantage of waste or surplus two-by-four lumber that is found at the construction site in order to provide improved, safe work conditions.

It is clear that the invention solves the problems associated with devices that simply cover a single bar and provide a cap over a metal plate that distributes impact loads over the cap. In addition to the disadvantages discussed earlier, these devices can still produce significant injury to a worker simply because the area that these devices provide for distributing the impact load is only about one and one half times the size of a man's fist. Therefore, a worker who falls on a device as shown in the prior art will experience an impact that is similar to being struck by a large fist. The instant invention, however, allows one to attach a long two-by-four over several bars, thus allowing much greater distribution of loads than could be achieved with the prior art.

Still further, it can be appreciated that the invention solves the problems associated with devices that make it easy for people to move around or pass by hazardous areas which should be avoided in the first place. The known prior art allows people to walk with ease through areas with exposed reinforcement bars. It will become readily apparent that the instant invention will also serve as a barricade to prevent workers from walking through hazardous areas that present a number of exposed bars.

It will should also be understood that the invention provides a very simple, cost effective apparatus and method for providing the safety advantages that are needed at construction sites. The instant invention allows the use of two-by-four pieces of lumber which are used throughout the construction site, and thus the invention provides a means for recycling or making more efficient use of lumber and building materials found at the construction site.

The disclosed invention also solves problems associated with the accidental removal of protective caps. It is well recognized that many of the protective caps currently available may be accidentally knocked off of the reinforcement bar by a passer by. The instant invention, on the other hand, allows a two-by-four to be placed over several exposed bars, thus providing greater support for the protective device and providing a more secure attachment of the protective device on the exposed bars.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it is understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
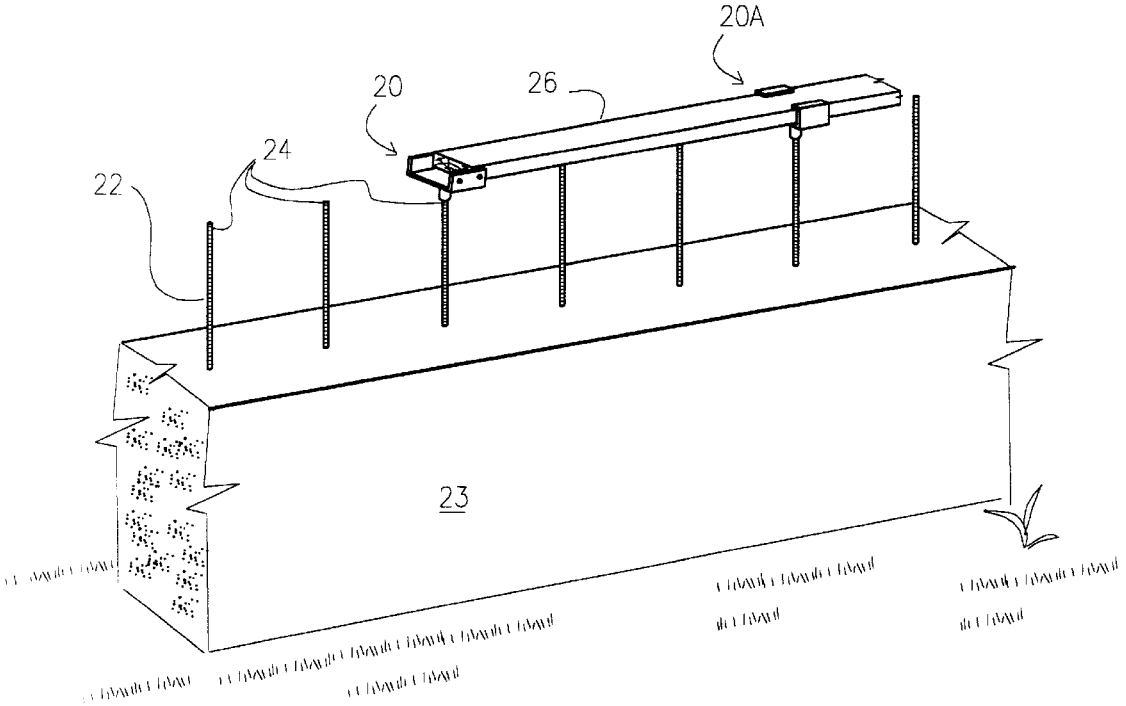
FIG. 1 shows a perspective view of a concrete section with several reinforcement bars covered by using two embodiments of the invention.
Figure 2:
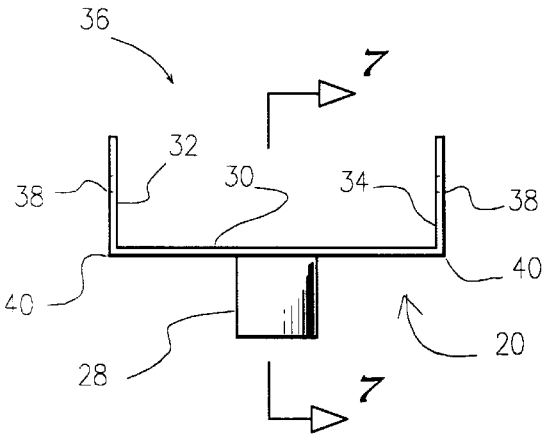
FIG. 2 is an end view of one embodiment of the invention.
Figure 3:
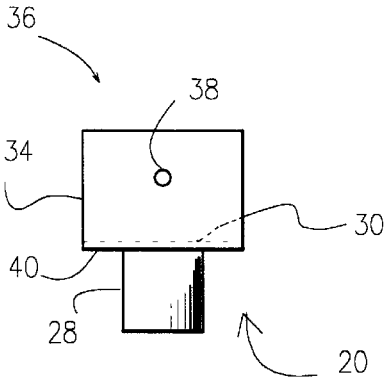
FIG. 3 is a side view of the embodiment shown on FIG. 2.

Referring now to FIGS. 1 through 3, which showing an apparatus 20 for covering an exposed end of a reinforcement bar 22 in a section of concrete 23. As has been illustrated in FIG. 1 a preferred embodiment of the apparatus 20 is mounted on an exposed end 24 of the reinforcement bar 22 and is designed for receiving and retaining a bumper means, which preferably is a two-by-four piece of lumber 26 held over the exposed end 24 of the exposed reinforcement bar 22.

As has been illustrated in FIG. 2, the apparatus 20 includes means for securing the apparatus 20 to the end 24 of the reinforcement bar 22. In a preferred embodiment the means for securing the apparatus 20 over the end 24 of the reinforcement bar 22 is an elongated cylindrical collar 28 which is fixedly attached to a substantially flat portion 30 which has been adapted for receiving the bumper means, or two-by-four piece of lumber 26. The cylindrical collar 28 is adapted for receiving the end 24 of the reinforcement bar 22, and includes means or projections for producing an interference type fit that allows the retention of the apparatus 20 over the end 24 of the reinforcement bar 22.

Thus, it can be appreciated that the cylindrical collar 28 allows the apparatus 20 to be placed over the exposed end 24 of the bar 22 and so that the bumper means may be placed over the substantially flat portion 30, so that the exposed end 24 of the reinforcement bar 22 is covered by the bumper means which is resting over the substantially flat portion 30, thereby preventing injury caused by contact with an exposed end 24 of the bar 22.

As has been illustrated in FIG. 2, a preferred embodiment of the apparatus 20 further includes a first side wall 32 and a second sidewall 34 emanating in a substantially vertical orientation from the substantially flat portion 30, and thus defining a generally saddle shaped portion 36 defined by the first side wall 32, the flat portion 30 and the second side wall 34. The saddle shaped portion 36 is adapted for receiving the two-by-four piece of lumber 26, which serves as the bumper means.

Since the two-by-four piece of lumber 26 serves as the bumper means which protects workers and passers by from injury such as impalement, it can be appreciated that it is desirable to provide means for securely retaining the two-by-four piece of lumber 26 within the saddle shaped portion 36. As has been illustrated in FIG. 3, it is contemplated that one embodiment of the invention may include at least one hole 38 in the first side wall 32 or in the second side wall 34, or in both side walls, so that a nail may be driven into the two-by-four piece of lumber 26 when the two-by-four piece of lumber 26 is seated within the saddle portion 36, in order to hold the two-by-four piece of lumber 26 securely in place.

Figure 4:
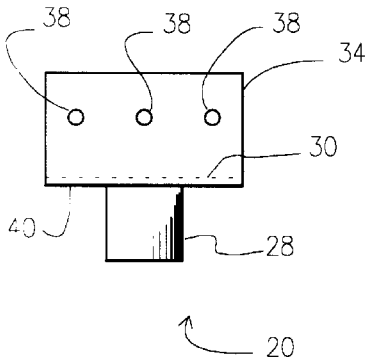
FIG. 4 is a side view of another embodiment of the invention, the embodiment including three attachment means for attaching a two-by-four piece of lumber.

As has been illustrated in FIG. 4, several holes 38 may be incorporated into the first side wall 32 or in the second side wall 34, or in both side walls. The advantage of having more than one hole 38 is that this arrangement also allows the apparatus 10 to serve as a joint or connector that allows two two-by-four pieces of lumber 26 to be butted up against each other by allowing a nail or a similar fastener to be inserted through the side walls and into each of the two-by-four pieces of lumber 26.

Figure 5:
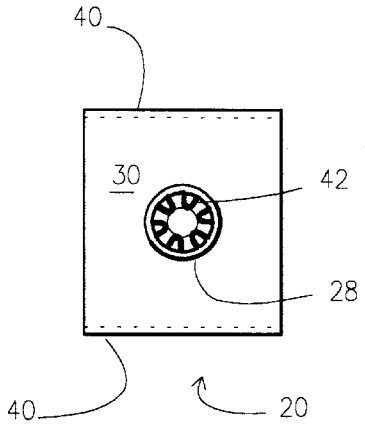
FIG. 5 is a bottom view showing an embodiment of an attachment means that may be used within the elongated cylindrical collar to attach the invention to a reinforcement bar.
Figure 6:
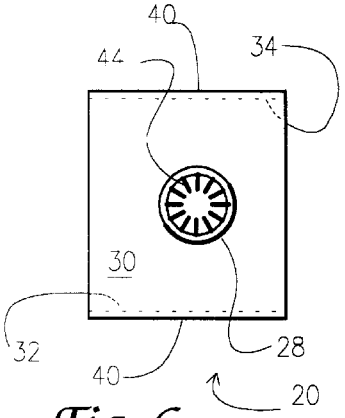
FIG. 6 is a bottom view showing another embodiment of an attachment means that may be used to attach the invention to a reinforcement bar.

Referring now to FIGS. 5 and 6, which show bottom views of embodiments of the apparatus 20, it is illustrated that the flat portion 30 preferably includes at least two substantially parallel edges 40, from which the first side wall 32 and the second side wall 34 originate in order to form the saddle shaped portion 36.

Figure 7:
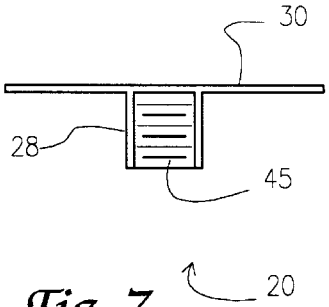
FIG. 7 is a sectional view taken from FIG. 2, and shows yet another embodiment of an attachment means that the may be used within the elongated cylindrical collar to attach the invention to a reinforcement bar.

Illustrated in FIGS. 5 through 7 are several means for securing the apparatus 20 to the end 24 of a reinforcement bar 22 by providing an interference type fit between the elongated cylindrical collar 28 and the end 24 of the reinforcement bar 22. As is shown on FIG. 5, it is contemplated that one embodiment of the means for securing the apparatus 20 to the end 24 of the reinforcement bar 22 may include a plurality of arched, hollow sleeves 42 which may flex as the end 24 of the reinforcement bar 22 is inserted into the elongated cylindrical collar 28. It will be appreciated that the arcked shape, together with the radial positioning of these hollow sleeves 42 will cooperate to produce slight resistance as the crest of the arch is deformed as a reinforcement bar is inserted, but will produce increasingly greater resistance, or gripping force, once the sleeves 42 are deformed to the point where they begin to bump into one another.

Other variations of the means for securing the apparatus 20 to the end 24 of the reinforcement bar 22, or means for providing an interference type fit between the elongated cylindrical collar 28 and the end 24 of the reinforcement bar 22, are shown on FIGS. 6 and 7. FIG. 6 shows the use of a plurality of radial fins 44, which are designed to flex as the end of a reinforcement bar is inserted. FIG. 7 shows a schematic for threads or flexible ribs 45 which extend within the elongated cylindrical collar 28. Thus, it can be appreciated that an important feature of the means used within the elongated cylindrical collar 28 for securing the apparatus 20 to the end 24 of a bar 22 is that the means be reusable and that they provide a secure hold to the bar 22.

Figure 8:
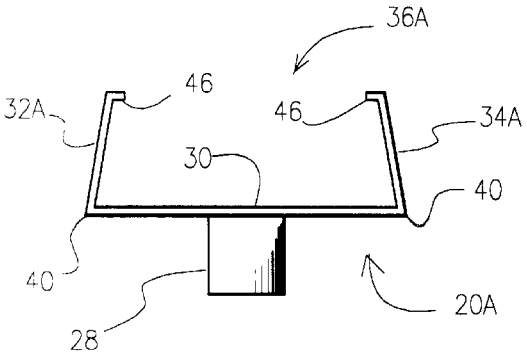
FIG. 8 is an end view of another embodiment of the invention, the embodiment including side walls which bias overhanging, cantilevered protrusions which serve to retain a two-by-four piece of lumber mounted over the invention.
Figure 9:
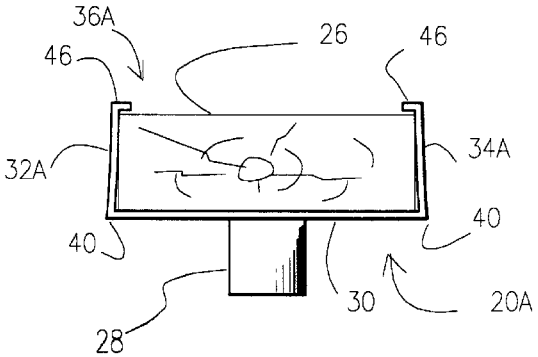
FIG. 9 is an end view of the embodiment illustrated in FIG. 8, together with a two-by-four piece of lumber seated on the invention.

Referring now to FIGS. 8 and 9, where another embodiment of the apparatus is shown and referred to as apparatus 20A. As can be appreciated from FIG. 8, this embodiment the apparatus 20A includes the elongated cylindrical collar 28 which is attached to the substantially flat portion 30 which also includes substantially parallel edges 40. In this embodiment, however, a first sidewall 32A and a second sidewall 34A have been incorporated as integral, converging members originating from the substantially parallel edges 40.

In this embodiment of the apparatus 20A the first sidewall 32A and the second sidewall 34A have been placed at a nearly vertical, converging orientation which can provide a spring bias against the two-by-four piece of lumber 26 placed over the substantially flat portion 30. Thus, in the embodiment illustrated in FIGS. 8 and 9, the first sidewall 32A, the second sidewall 34A and the substantially flat portion 30 define a saddle shaped portion 36A.

The apparatus 20A, also includes means for retaining the two-by-four piece of lumber 26 within the saddle shaped portion 36A. In a preferred embodiment the means for retaining the two-by-four pieces of lumber 26 in the saddle shaped portion 36A includes at least one cantilevered projection 46 adapted for retaining a two by four over said substantially flat portion 30. The cantilevered projection 46 may include a single projection or lip that extends along the first sidewall 32A at a distance from the parallel edge 40 that is adapted for accepting a two-by-four piece of lumber or a similar bumper means. Similarly, the cantilevered projection 46 may also be incorporated along the second sidewall 34A in a manner that is substantially parallel to the parallel edges 40, so that once the two-by-four piece of lumber 26 is inserted into the saddle shaped portion 36A it is held in place by the bias from the first sidewall 32A, the second sidewall 34A, and the cantilevered projection 46.

It is important to note that the configuration of the apparatus 20A produces some highly desirable results. First, the use of a substantially flat portion 30 over the elongated cylindrical collar 28, together with the first sidewall 32A and the second sidewall 34 and cantilevered projection 46 provides a simple structure that may be made entirely out of resilient plastic material. Thus, this configuration allows injection molding of the entire unit to produce a compete device. In other words, the configuration of the apparatus 20A will not require any additional fabrication steps such as the insertion of load distribution members such as metal disks. Also, the cantilevered projections 46 will retain a two-by-four piece of lumber without having to use nails or other retention devices.

Thus with the highly preferred configuration of the apparatus 20A one may quickly set up a safety barrier made up of a series of the apparatus 20A and two-by-four pieces of lumber placed between a pair of the apparatus 20A. The apparatus 20A is simply inserted over the end of an exposed bar and a two-by-four simply snapped into the saddle shaped portion 36A where it is held in place by the bias of the cantilevered projections 46.

Thus it can be appreciated that the cantilevered projection 46 are adapted for receiving and biasing the two-by-four piece of lumber 26 against the saddle shaped portion 36A. While the preferred embodiment of these cantilevered projections has been shown as flat flange, it is contemplated that these cantilevered projections may be barb-like sharp protrusions which are pressed against the two-by-our piece of lumber 26 by the bias from the first sidewall 32A and the second sidewall 34A. It is also contemplated that entire force that retains the two-by-our piece of lumber 26 within the saddle shaped portion 36 be provided by resiliency from the cantilevered projections 46, thus allowing the first sidewall 32A and the second sidewall 34A to be manufactured without a slight convergence.

Figure 10:
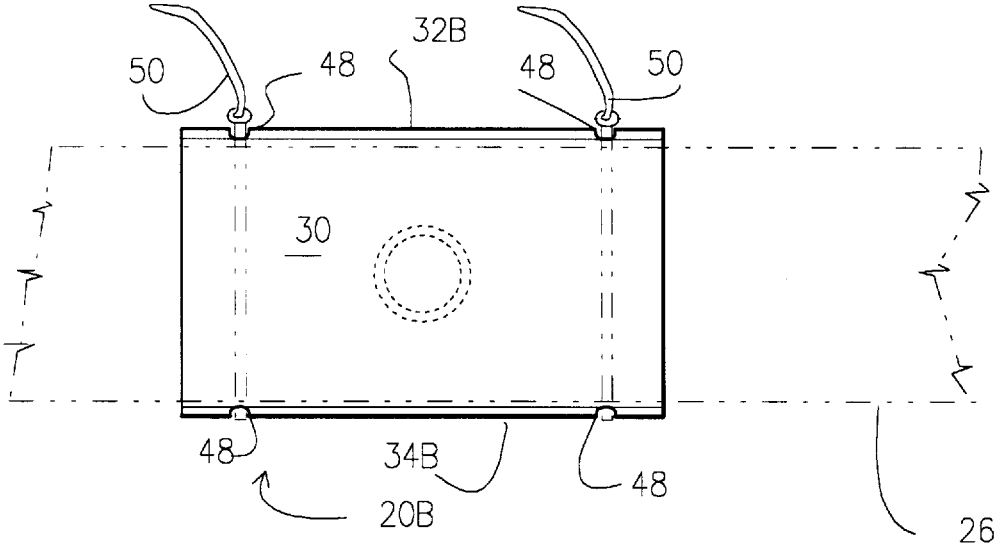
FIG. 10 is a top view of yet another embodiment of the invention. The illustrated embodiment employing ratcheting ties to retain a two-by-four piece of lumber over the invention.
Figure 11:
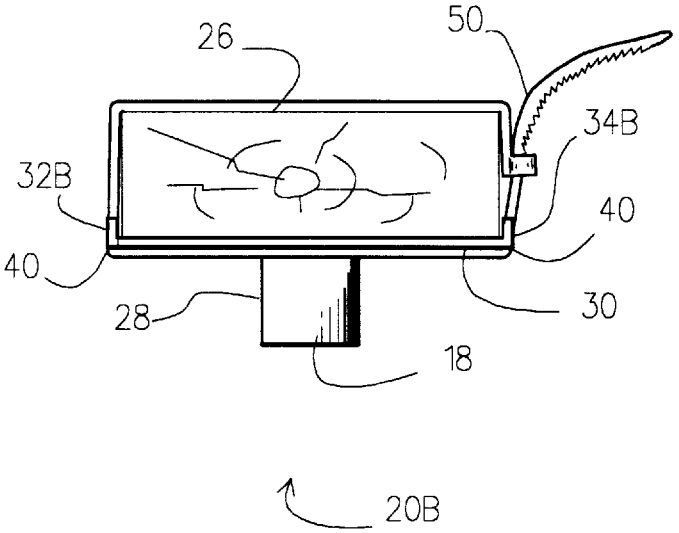
FIG. 11 is an end view of the embodiment shown on FIG. 10.

Yet another contemplated adjustment to the instant invention has been shown on FIGS. 10 and 11. In this variation, the apparatus 20B includes the elongated cylindrical collar 28, which serves as a means for securing the apparatus to the end of a bar, and the substantially flat portion 30 which has been adapted for receiving a bumper means. The embodiment shown on FIGS. 10 and 11 further includes substantially parallel edges 40 on the flat portion 30, and from the substantially parallel edges 40 arise a first sidewall 32B and a second sidewall 34B which have been adapted for receiving the two-by-four piece of lumber 26 therebetween. This embodiment of the apparatus 20*b* further includes at least one notch 48 or slot for receiving a tie 50 or other means for securing the two-by-four piece of lumber 26 against the substantially flat portion 30. Thus the invention may be placed over the end 22 of a bar 24, in order to allow the placement of a removable bumper means, such as the two-by-four piece of lumber 26, over the substantially flat portion 30 so that the exposed end of the bar is covered by the two-by-four piece of lumber 26 resting over the substantially flat portion 30.

According to yet another aspect of the instant invention, a method for covering an exposed end of at least one reinforcing bar at a construction site is taught. The method generally consists of the following steps: (1) attaching a cylindrical sleeve to the end of a bar the sleeve including a substantially flat portion, adapted for receiving a two-by-four piece of lumber, to the cylindrical sleeve; (2) placing a two-by-four piece of lumber over the substantially flat portion, so that the exposed end of the bar is covered by the two-by-four piece of lumber as it rests within the in the substantially flat portion, thereby preventing injury caused by contact with an exposed end of the bar.

It is contemplated that the instant invention may be easily manufactured by means of an injection molding process. Additionally, it may be found to be advantageous to fabricate the device from a fiber reinforced plastic or composite material in order to provide enhanced mechanical properties such as stiffness and elasticity. The addition of reinforcement would be particularly important in embodiments that use the side walls to bias or retain the two-by-four piece of lumber 26 over the substantially flat portion 30.

Thus, the described invention provides a means for protecting from injury from the exposed end of a reinforcement bar. It will be appreciated that the instant invention allows for more effective protection than could be achieved with other known devices due to the fact that once the invention has been installed over the exposed end 24 of a reinforcement bar 22, and a two-by-four piece of lumber 26 has been placed over the invention as shown in embodiments 20, 20A, or 20B, one can cover the ends of several exposed ends 24 with only two specimens of the invention and a two-by-four piece of lumber therebetween.

Once the invention has been installed, and several ends of reinforcement bars been covered, the two-by-four piece of lumber bumper means will allow any loads from, for example, a person falling over the two-by-four piece of lumber to be spread out over a much larger area than could achieved with protective devices in the known prior art. By spreading loads over a larger area one achieves increased safety and protective results because a fall on the larger bumper means is less likely to produce severe bruising or other injury. Also, by placing a large bumper means over several ends of reinforcement bars, one can even prevent people from entering hazardous areas, and thus avoiding exposing passers by from dangers. Still further, the ability to spread out loads over several reinforcement bars will result in a sturdier barrier which, at the same time, protects individuals from injury.

It will be appreciated by those skilled in the art that the above described embodiments are illustrative of just a few of the numerous variations of arrangements of the disclosed elements used to carry out the disclosed invention. While the invention has been particularly shown, described and illustrated in detail with reference to preferred embodiments and modifications thereof, it should be understood by that the foregoing and other modifications are exemplary only, and that equivalent changes in form and detail may be made without departing from the true spirit and scope of the invention as claimed, except as precluded by the prior art.

What is claimed is:

1. A safety apparatus for forming a temporary barricade and for temporarily covering ends of a plurality of exposed reinforcement bars having ends, the apparatus also serving for preventing injury from contact with the exposed reinforcement bars at a construction site, the apparatus comprising:

a collar of a resilient material, the collar having a plurality of radial fins of unitary construction with said collar for providing an interference fit between the fins and the ends of the reinforcement bars and allowing temporary attachment of the collar over the ends of the exposed reinforcement bars;

a resilient, unitary saddle shaped portion of one piece construction with said collar, the saddle shaped portion comprising:

a substantially flat portion that is integral with said collar;

a first side wall and a second side wall, the first side wall and the second side wall being unitary with the substantially flat portion and extending away from the substantially flat portion and away from said collar and converging towards one another so that the fist side wall and the second side wall are furthest from one another near the substantially flat portion, so that when said collar is slipped over the end of the exposed reinforcement bar the collar serves for frictional engagement with the end of the reinforcement bar, and so that the substantially flat portion is held over the end of the reinforcement bar by said collar, and so that a removable bumper means placed between the first side wall and the second side wall and over the substantially flat portion will cover at least one of the ends of the reinforcement bars, and so that a person falling over the end of the reinforcement bar will be protected from impalement with the reinforcement bar by the bumper and so that the person will not be injured by said safety apparatus due to the resiliency of the safety apparatus.

2. A safety device according to claim 1 wherein said substantially flat area is adapted for receiving a two-by-four section of lumber.

3. A safety device according to claim 1 wherein the first side wall and the second side wall include at least one protrusion at a distance from the flat portion for holding the removable bumper over the substantially flat portion.

4. A temporary barricade and protective system for preventing injury from impalement on an end of an exposed reinforcement bar at a construction site, the barricade and protective system covering three or more ends of exposed reinforcement bars, the reinforcement bars being substantially in-line with one another, the barricade and protective system comprising:

a pair of resilient supports for accepting a piece of lumber, each resilient support comprising:

a unitary collar of a resilient material, the collar having plurality of radial fins of unitary construction with said collar for providing an interference fit between the fins and the ends of the exposed reinforcement bars;

a unitary saddle shaped portion comprising:

a substantially flat portion of unitary construction with said collar;

a first resilient side wall and a second resilient said wall of unitary construction with said flat portion, the first side wall and the second side wall being integral with the substantially flat portion and extending away from the substantially flat portion, away from said collar and converging towards one another, so that when said collar is placed over the end of the exposed reinforcement bar the substantially flat portion is held over the end of the reinforcement bar by said collar, at least one section of lumber of a length that is sufficient to cover the ends of the three reinforcement bars, the pair of resilient supports being placed over two of the ends of the reinforcement bars and said section of lumber being placed between the first side wall and the second side wall and over the substantially flat portion of each resilient support to cover the ends of the three reinforcement bars, so that a person falling over the end of one of the reinforcement bars will be protected from impalement with the reinforcement bar by the section of lumber and so that the person will not be injured by said resilient supports due to the resiliency of the resilient supports.

5. A safety device according to claim 4 wherein the first side wall and the second side wall include at least one protrusion at a distance from the flat portion and away from said collar, for holding the removable bumper over the substantially flat portion.

6. A method for creating a barricade and covering an exposed end of at least two reinforcement bars at a construction site, the reinforcement bars having ends, the method comprising:

providing at least two supports for retaining a piece of lumber over the ends of the reinforcement bars, the supports comprising:

a collar of a resilient material, the collar having integral means for temporarily attaching the collar over the ends of the exposed reinforcement bars; and a saddle shaped portion comprising:

a substantially flat portion that is integral with said collar;

a first resilient side wall and a second resilient side wall, the first side wall and the second side wall being unitary with the substantially flat portion and extending away from the substantially flat portion, the first side wall, substantially flat portion, and second side wall defining the saddle shaped portion so that the saddle shaped portion opens away from said collar and the first side wall and the second side wall converging towards one another;

placing the collar of one of the supports over one of the reinforcement bars so that the substantially flat portion is held over the end of the reinforcement bar; placing the collar of another of the supports over another of the reinforcement bars so that the substantially flat portion is held over the end of the reinforcement bar;

providing at least one section of lumber of a length that is sufficient to extend between said supports; and placing the section of lumber over the saddle shaped portion of each support, so that the resiliency of each first side wall and each second side wall retain the piece of lumber over the substantially flat portions so that the section of lumber covers the ends of the reinforcement bars, and so that a person falling over the end of one of the reinforcement bars will be protected from impalement with the reinforcement bar by the bumper.

7. A method according to claim 6 wherein the integral means for temporarily attaching the collar over the ends of the exposed reinforcement bars comprises a plurality of radial fins of unitary construction with said collar for providing an interference fit between the fins and the ends of the reinforcement bars and allowing temporary attachment of the collar over the ends of the exposed reinforcement bars.

8. A method according to claim 7 wherein the first side wall and the second side wall include at least one protrusion at a distance from the flat portion and away from said collar, for holding the removable bumper over the substantially flat portion.

* * * * *